US012758013B2

(12) United States Patent
Chen et al.

(10) Patent No.: US 12,758,013 B2
(45) Date of Patent: Oct. 13, 2026

(54) SLIDE RAIL ASSEMBLY

(71) Applicants: King Slide Works Co., Ltd., Kaohsiung City (TW); King Slide Technology Co., Ltd., Kaohsiung City (TW)

(72) Inventors: Ken-Ching Chen, Kaohsiung City (TW); Shun-Ho Yang, Kaohsiung City (TW); Chun-Yi Ho, Kaohsiung City (TW); Chun-Chiang Wang, Kaohsiung City (TW)

(73) Assignees: King Slide Works Co., Ltd., Kaohsiung City (TW); King Slide Technology Co., Ltd., Kaohsiung City (TW)

( * ) Notice: Subject to any disclaimer, the term of this patent is extended or adjusted under 35 U.S.C. 154(b) by 65 days.

(21) Appl. No.: 18/967,249

(22) Filed: Dec. 3, 2024

(65) Prior Publication Data

US 2025/0386933 A1 Dec. 25, 2025

(30) Foreign Application Priority Data

Jun. 19, 2024 (TW) ..... 113122857

(51) Int. Cl.

| | |
|---|---|
| ***A47B 88/473*** | (2017.01) |
| ***A47B 88/443*** | (2017.01) |
| ***A47B 88/49*** | (2017.01) |

(52) U.S. Cl.

CPC ..... *A47B 88/473* (2017.01); *A47B 88/443* (2017.01); *A47B 88/49* (2017.01); *A47B 2210/007* (2013.01)

(58) Field of Classification Search

CPC ..... A47B 88/473; A47B 88/44; A47B 88/443; A47B 88/447; A47B 2210/007

See application file for complete search history.

(56) References Cited

U.S. PATENT DOCUMENTS

| | | | | |
|---|---|---|---|---|
| 8,147,011 | B2 | 4/2012 | Chen et al. | |
| 10,617,208 | B2 * | 4/2020 | Chen | F16C 29/12 |
| 2020/0392990 | A1 * | 12/2020 | Chen | F16C 29/04 |
| 2021/0145174 | A1 * | 5/2021 | Chen | A47B 88/443 |
| 2025/0151900 | A1 * | 5/2025 | Chen | A47B 88/473 |
| 2025/0325105 | A1 * | 10/2025 | Chen | A47B 88/487 |
| 2025/0366611 | A1 * | 12/2025 | Chen | A47B 88/443 |

FOREIGN PATENT DOCUMENTS

| | | | |
|---|---|---|---|
| CN | 219331097 | U | 7/2023 |
| EP | 3387950 | A1 | 10/2018 |

* cited by examiner

*Primary Examiner* — Daniel J Rohrhoff

(74) *Attorney, Agent, or Firm* — Best & Flanagan LLP

(57) ABSTRACT

A slide rail assembly includes two slide rails. During a process of a first one of the two slide rails being moved relative to a second one of the two slide rails along a predetermined direction, a first predetermined feature and a second predetermined feature are configured to contact each other to provide resistance in order to stop or slow down the relative movement between the two slide rails.

13 Claims, 7 Drawing Sheets

SLIDE RAIL ASSEMBLY

BACKGROUND OF THE INVENTION

1. Field of the Invention

The present invention relates to a slide rail mechanism, and more particularly, to a slide rail assembly capable of providing resistance to stop or slow down movement of a rail moving relative to another rail along a predetermined direction.

2. Description of the Prior Art

China patent publication number CN 219331097U discloses a ball slide rail with a buffering anti-rebound mechanism, which comprises an outer slide rail, an inner slide rail, and a middle slide rail arranged between the outer slide rail and the inner slide rail. A limiting mechanism is provided between the outer slide rail and the middle slide rail, and between the inner slide rail and the middle slide rail. The patent is characterized in that a first blocking mechanism with buffering anti-rebound function is arranged between the outer slide rail and the middle slide rail, and a second blocking mechanism with buffering anti-rebound function is arranged between the inner slide rail and the middle slide rail.

SUMMARY OF THE INVENTION

The present invention provides a slide rail assembly capable of providing resistance to stop or slow down movement of a rail moving relative to another rail along a predetermined direction.

According to an embodiment of the present invention, a slide rail assembly comprises a first rail, a second rail, a third rail and an auxiliary member. The first rail is arranged with a blocking feature. The third rail is movably mounted between the first rail and the second rail. The auxiliary member is movably mounted on the third rail. The auxiliary member is movable between a first state and a second state. The second rail is arranged with a first predetermined feature, and the third rail is arranged with a second predetermined feature. When the third rail is located at a predetermined position relative to the first rail and when the auxiliary member is in the first state, the blocking feature is configured to block the auxiliary member in order to prevent the third rail from being moved from the predetermined position along a predetermined direction. During a process of the second rail being moved a predetermined distance along the predetermined direction relative to the third rail located at the predetermined position, the first predetermined feature and the second predetermined feature are configured to contact each other in order to slow down movement of the second rail along the predetermined direction relative to the third rail.

According to another embodiment of the present invention, a slide rail assembly comprises a first rail, a second rail, a third rail and an auxiliary member. The first rail is arranged with a blocking feature. The third rail is movably mounted between the first rail and the second rail. The auxiliary member is movably mounted on the third rail. The second rail is arranged with a first predetermined feature, and the third rail is arranged with a second predetermined feature. When the third rail is located at a retracted position relative to the first rail and when the auxiliary member is in a first state, the blocking feature is configured to block the auxiliary member. During a process of the second rail being moved a predetermined distance along an opening direction relative to the third rail located at the retracted position, the first predetermined feature and the second predetermined feature are configured to contact each other in order to provide resistance to the second rail.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
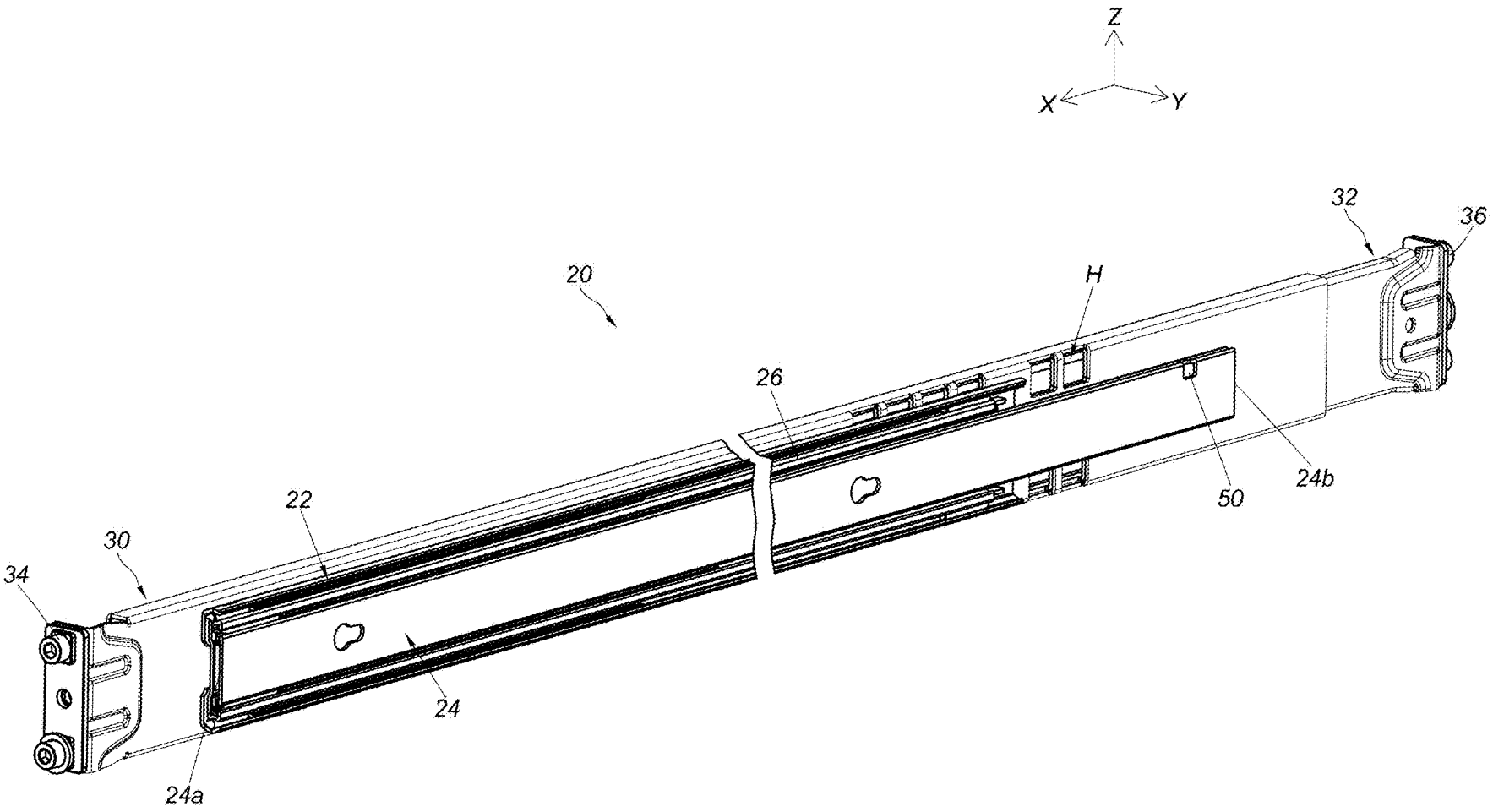
FIG. 1 is a diagram showing a slide rail assembly according to an embodiment of the present invention.
Figure 2:
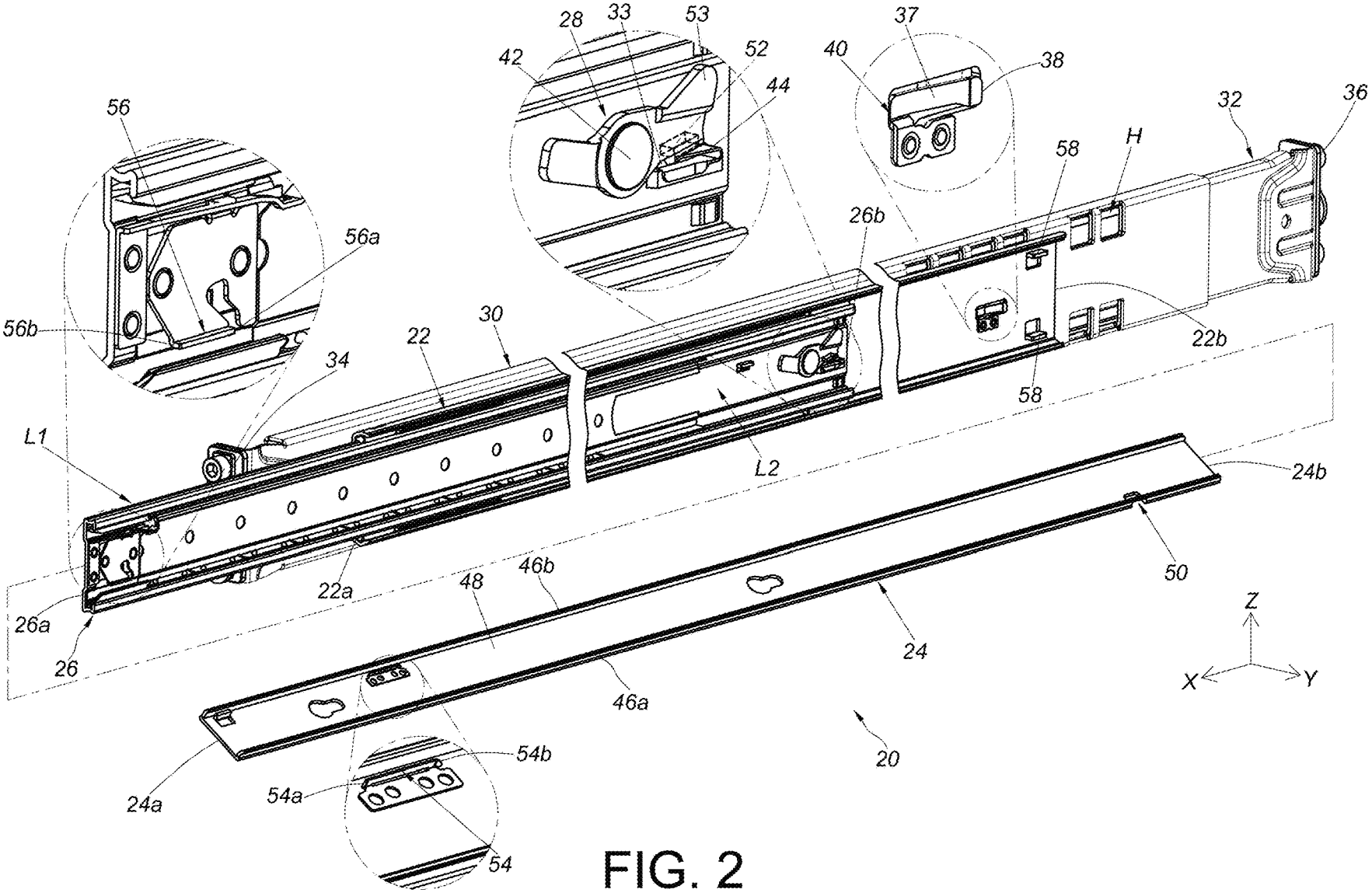
FIG. 2 is an exploded view of the slide rail assembly comprising a first rail, a second rail and a third rail according to the embodiment of the present invention.

As shown in FIG. 1 and FIG. 2, a slide rail assembly 20 comprises a first rail 22, a second rail 24, a third rail 26 and an auxiliary member 28 according to an embodiment of the present invention. The first rail 22, the second rail 24 and the third rail 26 are longitudinally movable relative to each other. In the figures, the X axis is a longitudinal direction (or a length direction or a moving direction of the slide rail), the Y axis is a transverse direction (or a lateral direction of the slide rail), and the Z axis is a vertical direction (or a height direction of the slide rail). Preferably, the slide rail assembly 20 further comprises a first bracket 30 (such as a front bracket) and a second bracket 32 (such as a rear bracket) mounted to a back side of the first rail 22. The first bracket 30 and the second bracket 32 are longitudinally adjustable and movable relative to each other, and the first rail 22 is configured to be mounted to a rack through first mounting members 34 of the first bracket 30 and second mounting members 36 of the second bracket 32. Preferably, at least one of the first bracket 30 and the second bracket 32 is formed with at least one ventilation hole H. In the present embodiment, the first bracket 30 and/or the second bracket 32 is formed with a plurality of ventilation holes H, but the present invention is not limited thereto. In addition, the second rail 24 is configured to carry a carried object.

The first rail 22 is arranged with a blocking feature 38. In the present embodiment, a predetermined member 40 is connected to the first rail 22, and the predetermined member 40 has an extension arm 37 arranged with the blocking feature 38. In other alternative embodiments, the blocking feature 38 can be a protrusion formed on the first rail 22. However, the present invention is not limited thereto. Furthermore, the first rail 22 has a first end part 22*a* and a second end part 22*b*, such as a front end part and a rear end part. The blocking feature 38 is located adjacent to the second end part 22*b* of the first rail 22.

The third rail 26 (such as a middle rail) is movably mounted between the first rail 22 (such as an outer rail) and the second rail 24 (such as an inner rail). The third rail 26 has a first end part 26*a* and a second end part 26*b*, such as a front end part and a rear end part.

The auxiliary member 28 is movably mounted on the third rail 26. Preferably, the auxiliary member 28 is pivotally connected to the third rail 26 through a shaft 42, and the slide rail assembly 20 further comprises an elastic member 44 configured to provide an elastic force to the auxiliary member 28. The elastic member 44 can be an elastic piece or a spring, but the present invention is not limited thereto. Preferably, the auxiliary member 28 is located adjacent to the second end part 26*b* of the third rail 26. Preferably, the auxiliary member 28 comprises an extension part 52 and an auxiliary part 53. Preferably, the third rail 26 has a first side L1 and a second side L2 opposite to each other. The extension part 52 of the auxiliary member 28 is extended to the first side LI of the third rail 26 and protruded relative to the third rail 26 to be adjacent to the first rail 22. For example, the auxiliary member 28 is movably mounted on the second side L2 of the third rail 26, and the extension part 52 of the auxiliary member 28 is configured to pass through a predetermined hole 33 of the third rail 26 to be extended toward the first rail 22. The extension part 52 of the auxiliary member 28 is configured to interact with the blocking feature 38 on the first rail 22. On the other hand, the auxiliary part 53 of the auxiliary member 28 is located at the second side L2 of the third rail 26 and adjacent to the second rail 24.

The second rail 24 has a first end part 24*a* and a second end part 24*b*, such as a front end part and a rear end part. The second rail 24 comprises a first wall 46*a*, a second wall 46*b* and a longitudinal wall 48 connected between the first wall 46*a* and the second wall 46*b* of the second rail 24. The second rail 24 comprises a working feature 50. In the present embodiment, the working feature 50 is arranged on the first wall 46*a* of the second rail 24, and the working feature 50 is a hole defined by a plurality of walls, but the present invention is not limited thereto. The working feature 50 is configured to interact with the auxiliary part 53 of the auxiliary member 28.

Furthermore, the second rail 24 is arranged with a first predetermined feature 54, and the third rail 26 is arranged with a second predetermined feature 56 configured to interact with the first predetermined feature 54. Specifically, the first predetermined feature 54 is arranged on the longitudinal wall 48 of the second rail 24. One of the first predetermined feature 54 and the second predetermined feature 56 has a guiding surface. In the present embodiment, the first predetermined feature 54 has a first guiding surface 54*a* and a second guiding surface 54*b* opposite to each other. Preferably, the first guiding surface 54*a* and the second guiding surface 54*b* can be inclined surfaces or arc surfaces. On the other hand, the second predetermined feature 56 has a first end 56*a* and a second end 56*b* opposite to each other.

Preferably, the first predetermined feature 54 is located adjacent to the first end part 24*a* of the second rail 24, and the second predetermined feature 56 is located adjacent to the first end part 26*a* of the third rail 26.

Preferably, at least one of the first predetermined feature 54 and the second predetermined feature 56 is a protrusion. In the present embodiment, both the first predetermined feature 54 and the second predetermined feature 56 are protrusions, but the present invention is not limited thereto.

Figure 3:
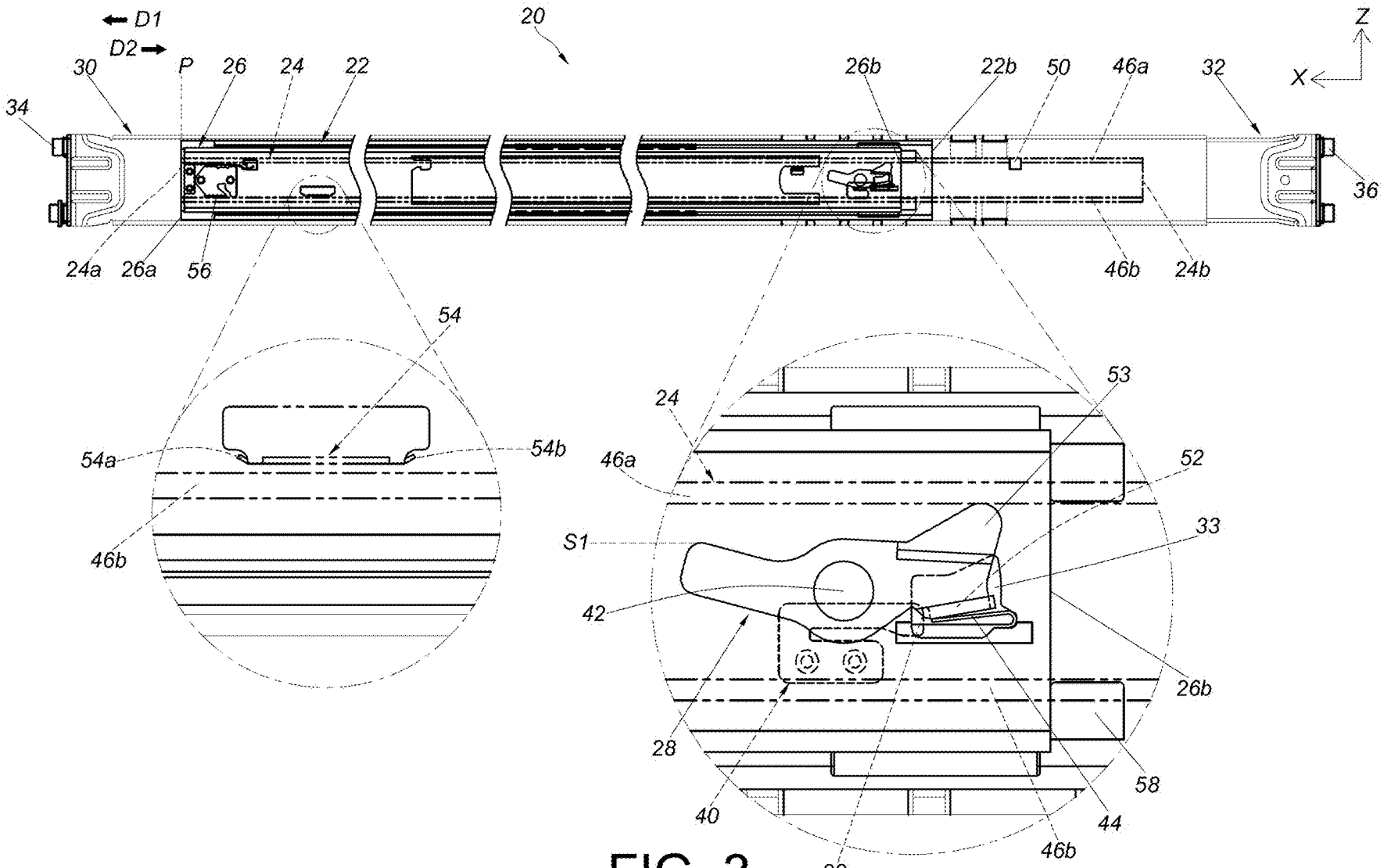
FIG. 3 is a diagram showing the slide rail assembly being in a retracted state according to the embodiment of the present invention.

As shown in FIG. 3, the slide rail assembly 20 is in a retracted state. Furthermore, the third rail 26 and the second rail 24 are located at a predetermined position P (such as a retracted position) relative to the first rail 22, and the first end parts 24*a*, 26*a* of the second rail 24 and the third rail 26 are adjacent to the first end part 22*a* of the first rail 22. When the third rail 26 is located at the predetermined position P relative to the first rail 22 and when the auxiliary member 28 is in a first state SI relative to the third rail 26, the blocking feature 38 is configured to block the extension part 52 of the auxiliary member 28, in order to prevent the third rail 26 from being moved from the predetermined position P along a predetermined direction D1 (such as an opening direction). When the auxiliary member 28 is in the first state S1, the auxiliary member 28 is configured to presses the elastic member 44, such that the elastic member 44 is in a state of accumulating an elastic force. Preferably, the first wall 46*a* of the second rail 24 is configured to abut against the auxiliary member 28 in order to hold the auxiliary member 28 in the first state S1. In addition, when the slide rail assembly 20 is in the retracted state, the first predetermined feature 54 and the second predetermined feature 56 are separated from each other by a predetermined distance along the longitudinal direction, and the working feature 50 and the auxiliary part 53 of the auxiliary member 28 are separated from each other by another predetermined distance along the longitudinal direction.

Preferably, the first rail 22 is further arranged with at least one blocking part 58 located adjacent to the second end part 22*b* of the first rail 22 and configured to block the second end part 26*b* of the third rail 26 in order to prevent the third rail 26 from being excessively moved along another predetermined direction D2 (such as a retracting direction) opposite to the predetermined direction D1.

Figure 4:
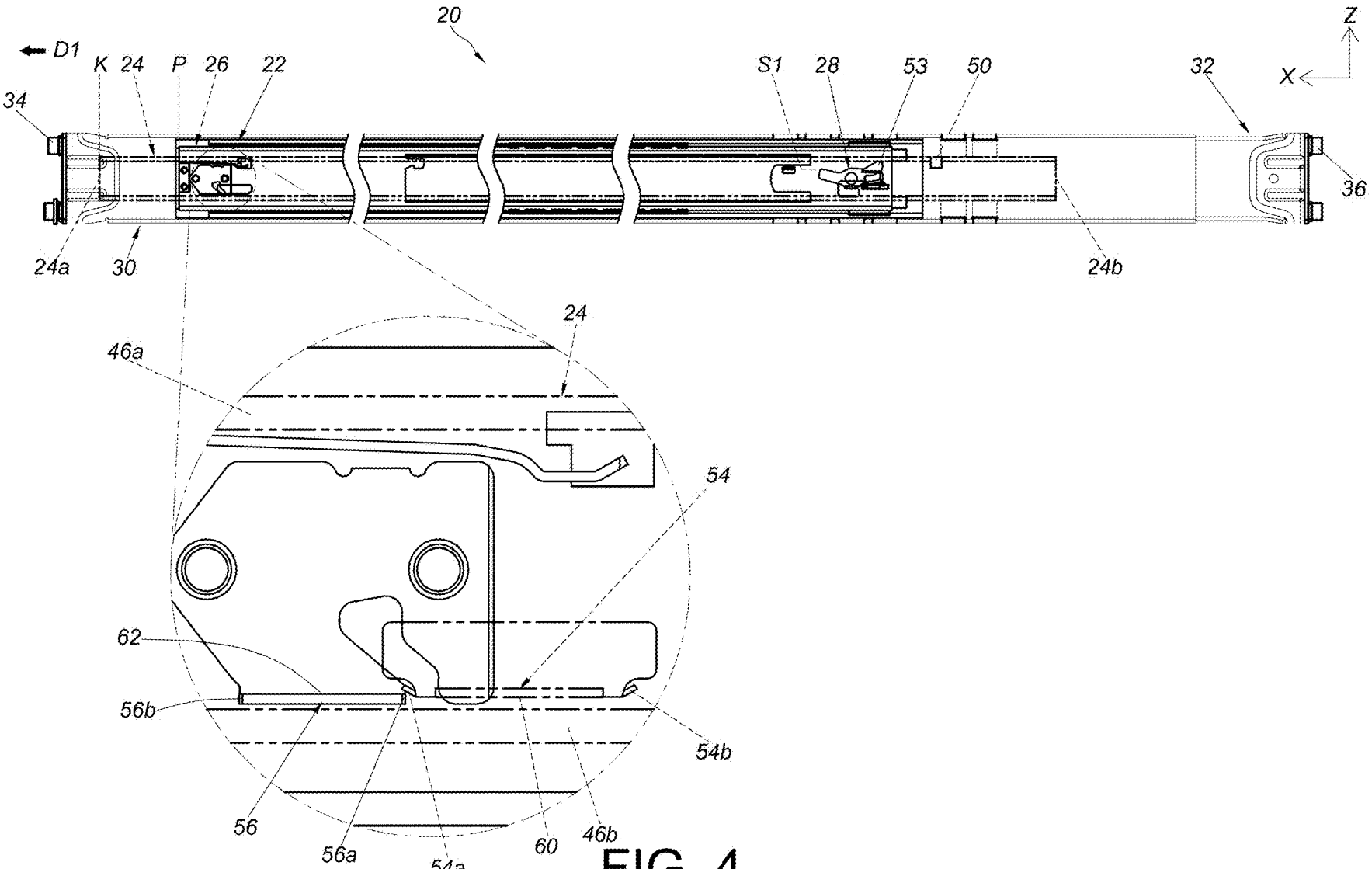
FIG. 4 is a diagram showing the second rail being moved relative to the first rail and the third rail along a predetermined direction according to the embodiment of the present invention.
Figure 5:
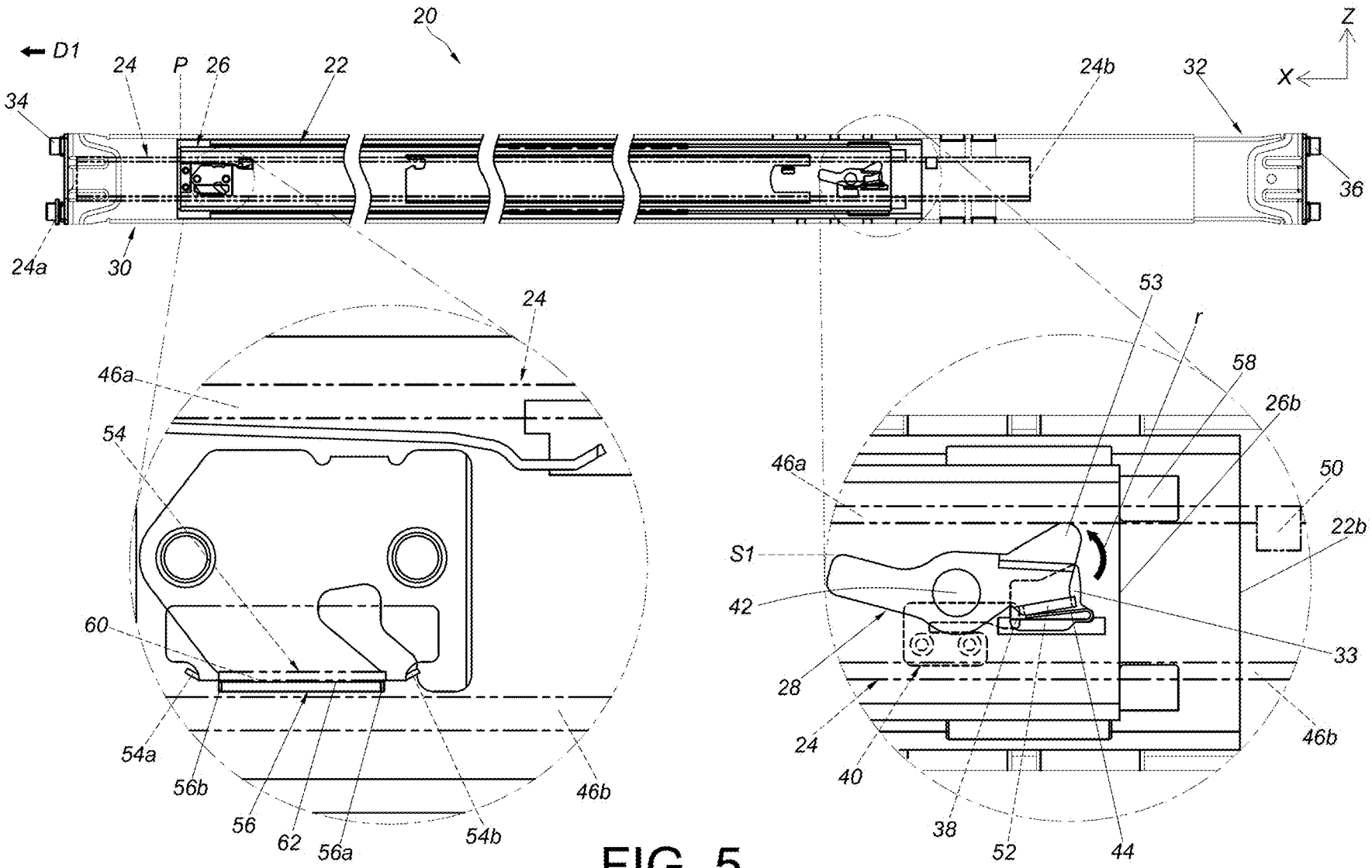
FIG. 5 is a diagram showing the second rail being further moved relative to the first rail and the third rail along the predetermined direction according to the embodiment of the present invention.
Figure 6:
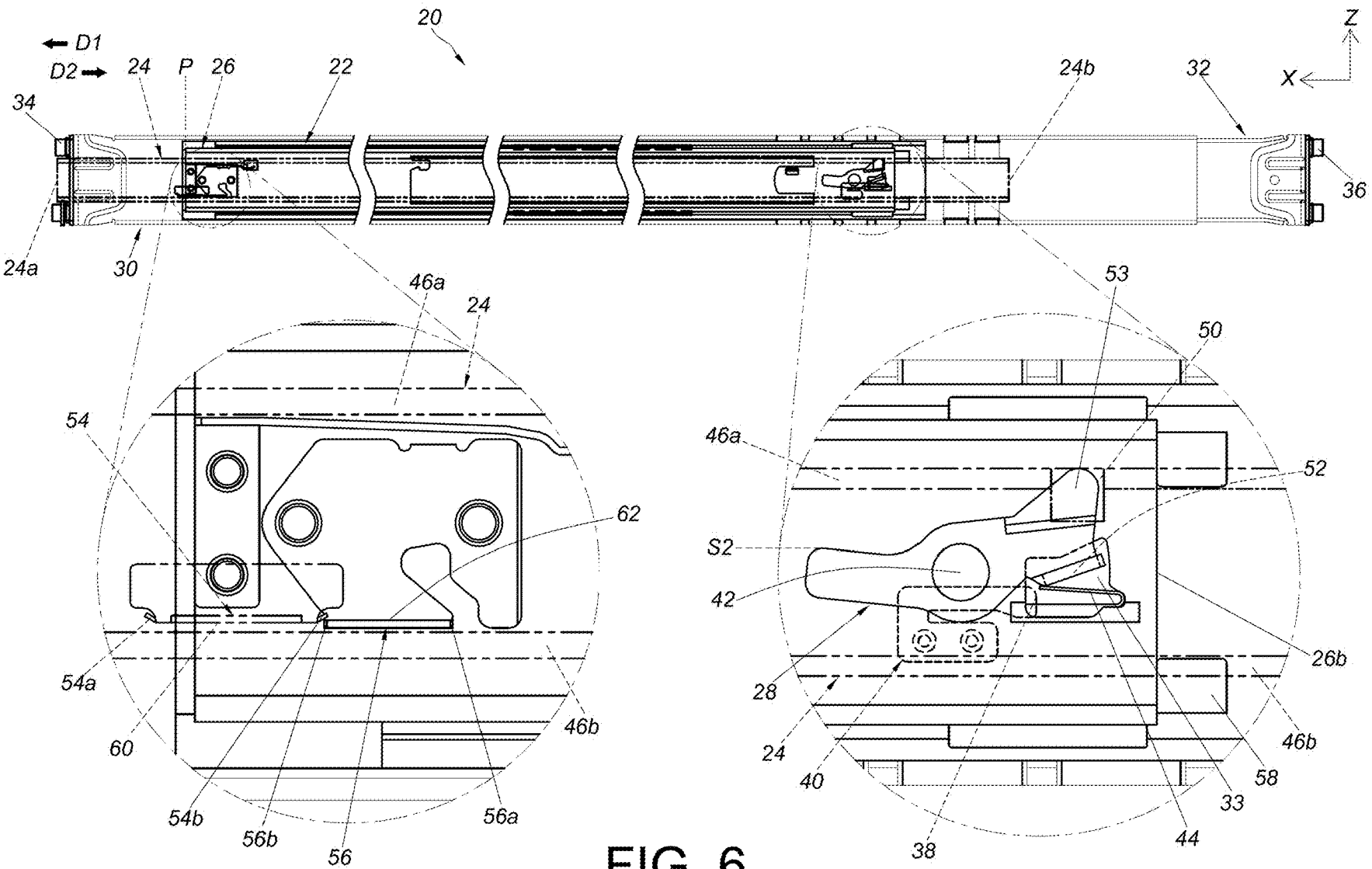
FIG. 6 is a diagram showing the second rail being further moved relative to the first rail and the third rail along the predetermined direction according to the embodiment of the present invention.

As shown in FIG. 4 to FIG. 6, during a process of the second rail 24 being moved a predetermined distance along the predetermined direction DI relative to the third rail 26 located at the predetermined position P, the first predetermined feature 54 and the second predetermined feature 56 are configured to contact each other with friction, so as to temporarily provide slight resistance to the second rail 24, in order to stop or slow down movement of the second rail 24 along the predetermined direction DI relative to the third rail 26.

Specifically, during the processing of the second rail 24 being moved along the predetermined direction D1 relative to the third rail 26, the first predetermined feature 54 and the first end 56*a* of the second predetermined feature 56 are configured to contact each other through the first guiding surface 54*a* in order to provide resistance to the second rail 24 (as shown in FIG. 4). If the movement of the second rail 24 along the predetermined direction D1 is very slow, or an operating force applied to the second rail 24 along the predetermined direction D1 is smaller than the resistance, the second rail 24 is configured to be stopped at a temporary position K by the resistance (as shown in FIG. 4).

Moreover, if the movement of the second rail 24 along the predetermined direction D1 is faster, or the operating force applied to the second rail 24 along the predetermined direction DI is greater than the resistance, the second rail 24 is configured to be further moved along the predetermined direction D1 from the temporary position K relative to the third rail 26 located at the predetermined position P. During such moving process of the second rail 24, a first surface 60 of the first predetermined feature 54 and a second surface 62 of the second predetermined feature 56 are configured to contact each other in order to provide resistance to the second rail 24 due to friction (as shown in FIG. 5) until the first predetermined feature 54 crosses over the second predetermined feature 56 along the predetermined direction D1 (as shown in FIG. 6).

Therefore, the first predetermined feature 54 and the second predetermined feature 56 are configured to contact each other to provide resistance to the second rail 24 due to friction, so as to slow down the movement of the second rail 24 along the predetermined direction D1 relative to the first rail 22 and the third rail 26, in order to avoid impact caused by the excessively fast moving speed of the second rail 24 along the predetermined direction D1, such that safety and/or protection is improved.

Preferably, when the second rail 24 is moved along the predetermined direction D1 relative to the third rail 26 located at the predetermined position P with the first predetermined feature 54 crossing over the second predetermined feature 56 along the predetermined direction D1, the working feature 50 is located adjacent to the auxiliary part 53 of the auxiliary member 28 to allow the auxiliary member 28 to move (to rotate along a rotating direction r) to switch from the first state S1 (shown in FIG. 5) to a second state S2 (as shown in FIG. 6), such that the auxiliary part 53 of the auxiliary member 28 and the working feature 50 are configured to be engaged with each other, so as to allow the second rail 24 and the third rail 26 to be synchronously moved along the predetermined direction D1 relative to the first rail 22. The auxiliary member 28 is moved to switch from the first state S1 to the second state S2 in response to the elastic force released by the elastic member 44. When the auxiliary member 28 is in the second state S2, the extension part 52 of the auxiliary member 28 and the blocking feature 38 on the first rail 22 are not aligned with each other along the longitudinal direction, such that the blocking feature 38 on the first rail 22 no longer blocks the extension part 52 of the auxiliary member 28, so as to allow the third rail 26 located at the predetermined position P to be driven by the second rail 24 to synchronously move with the second rail 24 along the predetermined direction D1.

In addition, as shown in FIG. 6, during a process of the second rail 24 being moved from an extended position along the predetermined direction D2 relative to the first rail 22, the first predetermined feature 54 and the second end 56*b* of the second predetermined feature 56 are configured to contact each other through the second guiding surface 54*b* in order to provide resistance to the second rail 24. During a process of the second rail 24 being further moved along the predetermined direction D2 relative to the first rail and the third rail 26, the first surface 60 of the first predetermined feature 54 and the second surface 62 of the second predetermined feature 56 are configured to contact each other in order to provide resistance to the second rail 24 due to friction (please also refer to FIG. 5) until the first predetermined feature 54 crosses over the second predetermined feature 56 along the predetermined direction D2. As such, the moving speed of the second rail 24 along the predetermined direction D2 relative to the first rail 22 and the third rail 26 is reduced, in order to avoid impact caused by the excessively fast moving speed of the second rail 24 along the predetermined direction D2, such that safety and/or protection is improved.

Figure 7:
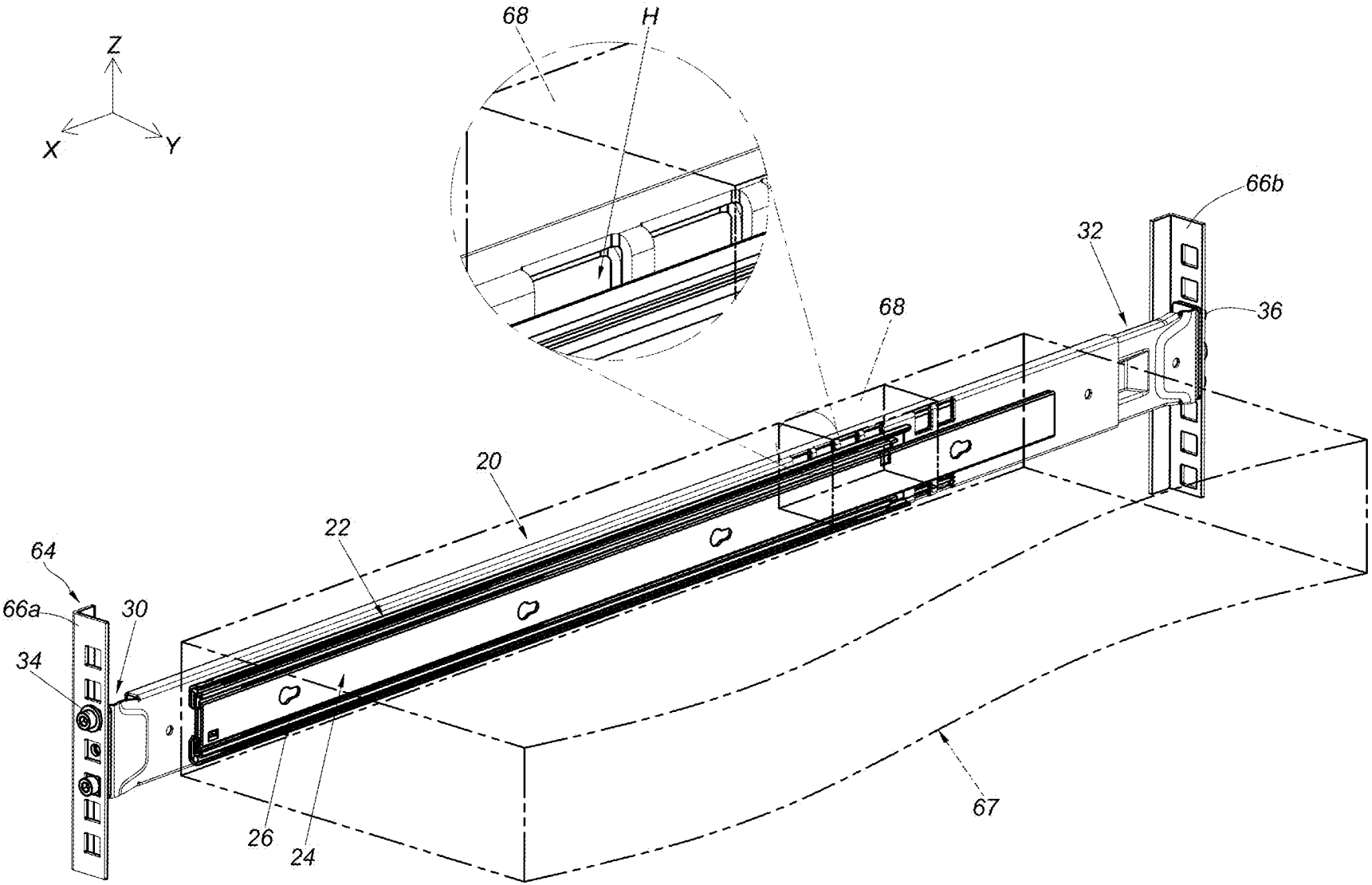
FIG. 7 is a diagram showing a carried object being mounted to a rack through the slide rail assembly according to the embodiment of the present invention.

As shown in FIG. 7, the slide rail assembly 20 is applicable to a rack 64. The rack 64 comprises a first post 66*a* and a second post 66*b*, and the first post 66*a* and the second post 66*b* are separated from each other by a longitudinal distance. The first rail 22 is configured to be mounted to the first post 66*a* and the second post 66*b* through the first bracket 30 (the first mounting members 34 of the first bracket 30) and the second bracket 32 (the second mounting members 36 of the second bracket 32). The slide rail assembly 20 is in the retracted state, and the second rail 24 is configured to carry a carried object 67 (such as an electronic device). When the first bracket 30 and the second bracket 32 are respectively mounted to the first post 66*a* and the second post 66*b*, the ventilation holes H of the first bracket 30 and/or the second bracket 32 are configured to dissipate heat from a predetermined part 68 of the carried object 67.

Therefore, the slide rail assembly 20 according to the embodiments of the present invention has the following technical features: during the process of the second rail 24 being moved along the predetermined direction DI relative to the first rail 22 and the third rail 26, the first predetermined feature 54 and the second predetermined feature 56 are configured to contact each other to provide resistance to the second rail 24 due to friction, in order to slow down the movement of the second rail 24. Within extremely limited space inside the slide rail assembly, a temporary buffering and holding mechanism is provided when pulling out the slide rail, in order to avoid the impact caused by the excessively fast moving speed of the second rail 24 (and the carried object 67) along the predetermined direction D1, such that safety and/or protection is improved.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail assembly, comprising:

a first rail arranged with a blocking feature;

a second rail;

a third rail movably mounted between the first rail and the second rail; and an auxiliary member movably mounted on the third rail, the auxiliary member being movable between a first state and a second state;

wherein the second rail is arranged with a first predetermined feature, and the third rail is arranged with a second predetermined feature;

wherein when the third rail is located at a predetermined position relative to the first rail and when the auxiliary member is in the first state, the blocking feature is configured to block the auxiliary member in order to prevent the third rail from being moved from the predetermined position along a predetermined direction;

wherein during a process of the second rail being moved a predetermined distance along the predetermined direction relative to the third rail located at the predetermined position, the first predetermined feature and the second predetermined feature are configured to contact each other in order to slow down movement of the second rail along the predetermined direction relative to the third rail;

wherein one of the first predetermined feature and the second predetermined feature has a first guiding surface; wherein during the process of the second rail being moved the predetermined distance along the predetermined direction relative to the third rail located at the predetermined position, the first predetermined feature and the second predetermined feature are configured to contact each other through the first guiding surface in order to slow down the movement of the second rail along the predetermined direction relative to the third rail;

wherein during a process of the second rail being further moved along the predetermined direction relative to the third rail located at the predetermined position, the first predetermined feature and the second predetermined feature are configured to contact each other in order to provide resistance to the second rail due to friction until the first predetermined feature crosses over the second predetermined feature.

2. The slide rail assembly of claim 1, wherein the second rail comprises a working feature, and the auxiliary member comprises an auxiliary part; wherein during the process of the second rail being moved along the predetermined direction relative to the third rail located at the predetermined position, the auxiliary member is moved to switch from the first state to the second state such that the auxiliary part of the auxiliary member and the working feature are configured to be engaged with each other, in order to allow the second rail and the third rail to be synchronously moved relative to the first rail along the predetermined direction.

3. The slide rail assembly of claim 1, wherein the one of the first predetermined feature and the second predetermined feature, which has the first guiding surface, further has a second guiding surface opposite to the first guiding surface.

4. The slide rail assembly of claim 1, wherein the auxiliary member is pivotally connected to the third rail through a shaft.

5. The slide rail assembly of claim 4, further comprising an elastic member configured to provide an elastic force to the auxiliary member.

6. The slide rail assembly of claim 1, wherein at least one of the first predetermined feature and the second predetermined feature is a protrusion.

7. The slide rail assembly of claim 1, wherein each of the second rail and the third rail has a first end part and a second end part; wherein the first predetermined feature is located adjacent to the first end part of the second rail, and the second predetermined feature is located adjacent to the first end part of the third rail.

8. The slide rail assembly of claim 7, wherein the first rail has a first end part and a second end part; wherein the blocking feature is located adjacent to the second end part of the first rail, and the auxiliary member is located adjacent to the second end part of the third rail; wherein when the slide rail assembly is in a retracted state, the first end parts of the second rail and the third rail are adjacent to the first end part of the first rail.

9. A slide rail assembly, comprising:

a first rail arranged with a blocking feature;

a second rail;

a third rail movably mounted between the first rail and the second rail; and an auxiliary member movably mounted on the third rail;

wherein the second rail is arranged with a first predetermined feature, and the third rail is arranged with a second predetermined feature;

wherein when the third rail is located at a retracted position relative to the first rail and when the auxiliary member is in a first state, the blocking feature is configured to block the auxiliary member;

wherein during a process of the second rail being moved a predetermined distance along an opening direction relative to the third rail located at the retracted position, the first predetermined feature and the second predetermined feature are configured to contact each other in order to provide resistance to the second rail;

wherein one of the first predetermined feature and the second predetermined feature has a first guiding surface; wherein during the process of the second rail being moved the predetermined distance along the opening direction relative to the third rail located at the retracted position, the first predetermined feature and the second predetermined feature are configured to contact each other through the first guiding surface in order to stop the second rail at a temporary position;

wherein during a process of the second rail being further moved from the temporary position along the opening direction relative to the third rail located at the retracted position, the first predetermined feature and the second predetermined feature are configured to contact each other in order to provide resistance to the second rail due to friction until the first predetermined feature crosses over the second predetermined feature.

10. The slide rail assembly of claim 9, wherein the second rail comprises a working feature, and the auxiliary member comprises an auxiliary part; wherein during the process of the second rail being moved along the opening direction relative to the third rail located at the retracted position, the auxiliary member is moved to switch from the first state to a second state, and the blocking feature no longer blocks the auxiliary member, and the auxiliary part of the auxiliary member and the working feature are configured to be engaged with each other, such that the second rail and the third rail are synchronously movable relative to the first rail along the opening direction.

11. The slide rail assembly of claim 9, wherein the auxiliary member is pivotally connected to the third rail through a shaft.

12. A slide rail assembly, comprising:

a first rail arranged with a blocking feature;

a second rail;

a third rail movably mounted between the first rail and the second rail; and an auxiliary member movably mounted on the third rail, the auxiliary member being movable between a first state and a second state;

wherein the second rail is arranged with a first predetermined feature, and the third rail is arranged with a second predetermined feature;

wherein when the third rail is located at a predetermined position relative to the first rail and when the auxiliary member is in the first state, the blocking feature is configured to block the auxiliary member in order to prevent the third rail from being moved from the predetermined position along a predetermined direction;

wherein during a process of the second rail being moved a predetermined distance along the predetermined direction relative to the third rail located at the predetermined position, the first predetermined feature and the second predetermined feature are configured to contact each other in order to slow down movement of the second rail along the predetermined direction relative to the third rail;

wherein the auxiliary member is pivotally connected to the third rail through a shaft.

13. A slide rail assembly, comprising:

a first rail arranged with a blocking feature;

a second rail;

a third rail movably mounted between the first rail and the second rail; and an auxiliary member movably mounted on the third rail, the auxiliary member being movable between a first state and a second state;

wherein the second rail is arranged with a first predetermined feature, and the third rail is arranged with a second predetermined feature;

wherein when the third rail is located at a predetermined position relative to the first rail and when the auxiliary member is in the first state, the blocking feature is configured to block the auxiliary member in order to prevent the third rail from being moved from the predetermined position along a predetermined direction;

wherein during a process of the second rail being moved a predetermined distance along the predetermined direction relative to the third rail located at the predetermined position, the first predetermined feature and the second predetermined feature are configured to contact each other in order to slow down movement of the second rail along the predetermined direction relative to the third rail;

wherein each of the second rail and the third rail has a first end part and a second end part;

wherein the first predetermined feature is located adjacent to the first end part of the second rail, and the second predetermined feature is located adjacent to the first end part of the third rail.

* * * * *